United States Patent [19]

Christie

[11] Patent Number: 4,739,778

[45] Date of Patent: Apr. 26, 1988

[54] PRODUCT SAMPLING DISPENSER

[76] Inventor: Sharon K. Christie, 420 E. 79th St./8D, New York, N.Y. 10021

[21] Appl. No.: 49,667

[22] Filed: May 13, 1987

[51] Int. Cl.[4] ..... A45D 40/26

[52] U.S. Cl. ..... 132/88.7

[58] Field of Search ..... 401/130–134; 132/88.7, 88.5

[56] References Cited

U.S. PATENT DOCUMENTS

| | | | |
|---|---|---|---|
| 3,806,260 | 4/1974 | Miller | 401/132 |
| 3,826,259 | 7/1974 | Bailey | 401/132 |
| 4,127,339 | 11/1978 | Malacheski | 401/132 |
| 4,475,835 | 10/1984 | Verbuum | 401/132 |

*Primary Examiner*—Gregory E. McNeill

*Attorney, Agent, or Firm*—Beehler, Pavitt, Siegemund, Jagger, Martella & Dawes

[57] ABSTRACT

A sampler applicator for a product having a smearable surface, such as lipstick, comprising a thin planar elongated plastic element molded to provide a handle segment and a pod area. The pod is formed out of the plane of the element and holds a small sample of the product, and is covered by a peelable adhesive sheet which may extend over the entire face of the element. The pod may be at least partially surrounded by a molded U-shaped wall of thinner material and also extending out of the element plane beyond the pod to enable the pod with the sample to be popped up above the plane of the element by the application of finger pressure to the back of the pod, or by bending of the element about an axis extending through the pod.

7 Claims, 3 Drawing Sheets

PRODUCT SAMPLING DISPENSER

FIELD OF THE INVENTION

This invention relates generally to the field of product sampling dispensers, and, in particular, to means for dispensing for testing, samples of a product in a plastic or smearable state, such as lipstick, other cosmetics and paint.

BACKGROUND OF THE INVENTION

The cosmetic industry today, particularly in the United States, enjoys a sales volume which is exceeded by very few other industries. Among the numerous cosmetic products so sold, lipsticks account for a substantial share of today's cosmetic market.

Once a women has selected a particular brand and color of lipstick, she may generally repurchase that particular brand and color. However, women are often tempted to try other brands and colors in an effort either to change or improve their respective appearances. In addition, there are always young women, and sometimes even older women, who may be trying lipstick for the first time. Most of these purchasers of different brands and colors, and new purchasers desire to sample various brands and colors in which they may be interested before purchasing any full-size lipstick in that brand and color.

Heretofore, lipstick sampling has been carried out at the counter of a retail store by using a "tester". Such a "tester" has been an actual lipstick provided, usually by and at the expense of the manufacturer of lipsticks corresponding to that of the "tester", at the retail counter for use by all consumers. In the department stores, drug stores and other retail establishments selling cosmetics, each "tester" over a period of time could be handled by as many as hundreds of people, each of whom may have picked up the tester lipstick and applied it either to her hand or lips for color and texture evaluation. Obviously, the use of "testers" in this manner can present health hazards since a fluid on the lips of the testing party may be passed on to the surface of the lipstick "tester". With recent public concern over the spread of such diseases as AIDS and herpes, many potential purchasers have become reluctant to apply tester lipsticks to their own lips, or even to the skin of their hands, choosing instead to smear the tester lipstick on a tissue or some other disposable item. However, the appearance of a particular type and color of a lipstick on such a tissue or other disposable item may not properly reveal how the particular brand and color would appear on the lips of a testing consumer.

Wholly apart from the health hazard presented by such public use of "testers" are other problems inherent in their use. For one thing, providing "testers" entails considerable expense to the manufacturer since each "tester" may be a full size lipstick. Also, the "tester" may be quickly used up since most women tend to wipe off its surface before applying it to their own lips, and careless handling or other mishandling may result in breakage of the lipstick. Additionally, at a busy retail counter, some patrons may simply pick-up and walk away with the "tester". The use of testers, therefore, has heretofore represented a substantial financial expense to the manufacturerer of the lipstick incorporated in the testers.

In addition, lipstick samplers—particularly after they have been used a number of times—can become quite messy and unattractive to potential customers for lipsticks corresponding to the testers.

While some consideration has been given to peelable packages for cosmetics, none of those, such as disclosed U.S. Pat. Nos. 2,606,565 or 2,557,141, has been devised for suitability as a lipstick sampler.

Also, make-up applicators in the form of matchbooks have been the subject of U.S. Pat. Nos. 2,303,986 and 4,471,874, but such applicators present considerable problems when sought to be used as lipstick applicators, since the tips may quickly become dried and harden and, as such, unusuable.

In summary, then lipstick sampling, as heretofore accomplished, has presented serious health risks and inconvenience to customers using them, and has proved expensive to the product manufacturers.

Other problems have been inherent in providing test samples of other cosmetics, paints and other products which cannot long be exposed to the atmosphere and are in a plastic or smearable state.

SUMMARY OF THE INVENTION

The sampling dispenser of the present invention, when used for lipstick sampling, provides a sterile "one shot" application of a quantity of lipstick sufficient to enable a potential purchaser to determine the suitability for her own use of the brand and color represented by the sample. The product sample (e.g. lipstick) is deposited in a pod molded in an elongated planar element of a plastic, such as polyvinyl chloride, or other suitable plastic of sufficient thickness to hold the shape of the pod after it has been molded in the planar plastic element, but thin enough to be readily flexed by the finger of a user. As so molded the pod is defined by a bottom wall and a side wall the rim of which for lipstick applications is below the plane of the plastic element. In addition, a U-shaped cavity is molded at least partially around the pod and defined by a second wall of lesser thickness than the pod wall to enable the pod to be "popped up" above the plane of the plastic element. Immediately following the deposit of the product in the pod, the product is covered and sealed by a thin impervious plastic sheet which is laid over and placed in sealable but removable contact with the rim of the second wall around the pod. The thus-sealed pod serves to preserve the product in the condition in which it has been deposited in the pod. When it is desired to use the sample, the plastic cover sheet may be readily peeled off the elongated planar element, including the second wall around the pod itself, thereby exposing the product for application by the person desiring to test the product content. Because of the flexibility of the elongated planar element in which the product carrying pod has been formed, it may readily be bent back sufficiently to cause the pod to pop up above the plane of the element so that the product in the pod may be applied to whatever surface on which it is to be tested, e.g., to the lips of the sampling party, in the case where the product is lipstick. Alternatively, the pod may be popped up out of the element plane by merely placing a finger on the back side of the bottom wall of the pod and pushing. By molding the U-shaped cavity out of the element plane a greater distance than the bottom wall defining the pod, a finger receiving recess is provided to popping the pod up, and this readily occurs particularly where the second wall is thinner than the pod wall and the plastic element itself.

It may be seen that a product sampling dispenser made in accordance with the invention of the present application thus provides a potential customer with a small completely sterile fresh quantity of the product sufficient to enable the party to apply what is needed to any surface on which it is to be tested. In the case of a lipstick product, this surface would be the lips of the woman using the sample. Following the test, the elongated plastic element is simply disposed of. The planar element itself and/or its covering sheet may be printed with identifying information relating to the product which its pod contains, sufficient to enable the person who may become satisfied with the product sample, to order a proper corresponding full size container of the product. Such printing could also identify the manufacturer, and even provide advertising. In addition, the element could be shaped and colored to correspond with the shape and color of the lipstick or other item for which it is a sample.

When used to provide a lipstick sample, the dispenser of the present invention may be made and filled most inexpensively, with the result that the lipstick manufacturer is no longer confronted with the substantial expenses and losses heretofor attributable to providing full size "testers" to enable potential customers to sample its lipstick products. In addition, an opportunity is provided to enable a consumer to cross sample products at a fraction of the cost of doing this by previously used "testers". In addition, there need be no further concern with breakage, messiness or pilferage, as where full size lipstick testers are being used by a number of persons at point-of-sale retail establishments.

Most attractive of all, however, is the fact that each sampler is used only once by a single person, thereby eliminating any possibility of such person being exposed to viruses or bacteria deposited by, or which may have been otherwise picked up from contact with the lips or fingers of previous users of a "tester" of the type heretofore available.

BRIEF DESCRIPTION OF THE DRAWINGS

In the accompanying drawings.

DESCRIPTION OF THE PREFERRED EMBODIMENT

Figure 1:
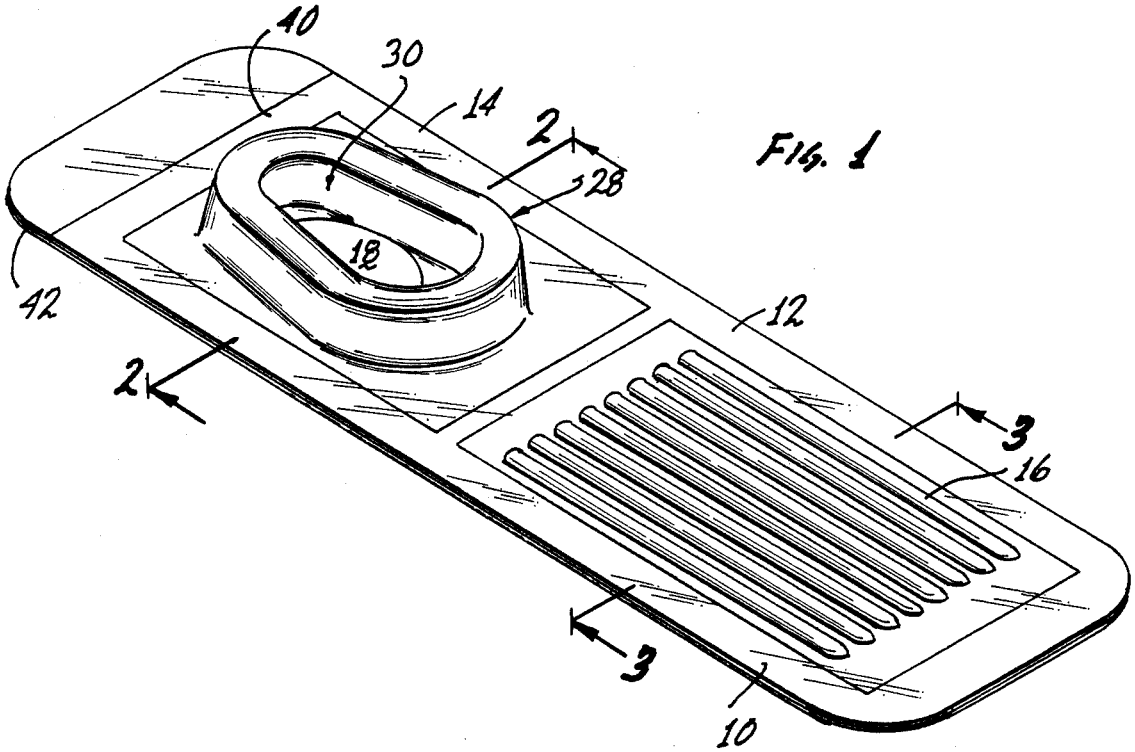
FIG. 1 is a perspective view of the preferred form of the dispenser applicator of the present invention, viewed from its underside.
Figure 2:
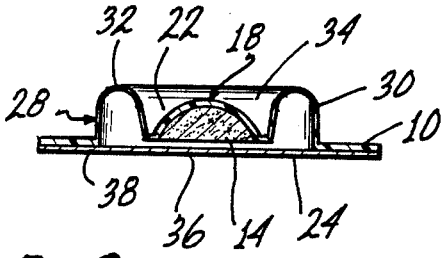
FIG. 2 is a section taken on the line 2—2 of FIG. 1.
Figure 3:
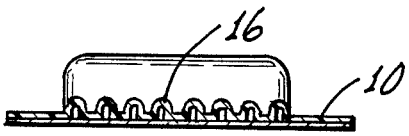
FIG. 3 is a section taken on the line 3—3 of FIG. 1.

The preferred embodiment of the invention is illustrated in FIGS. 1, 2, 3, and 7. An elongated planar element 10, which may be of polyvinyl chloride, is molded to provide a handle segment 12 and a pod area 14. The handle segment I2 may be molded to provide a series of elongated gripping and strengthening ribs 16, each of which may be U-shaped in cross-section as shown in FIG. 3.

Figure 8A:
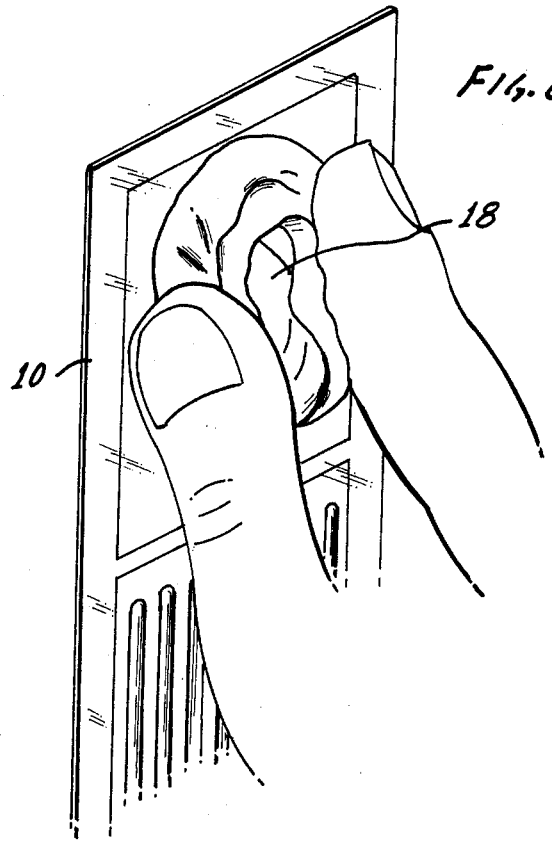
FIG. 8A is a perspective view of the back side of the sampler showing how the product containing pod may be popped up from the front side for use in the manner illustrated in FIG. 9.
Figure 8B:
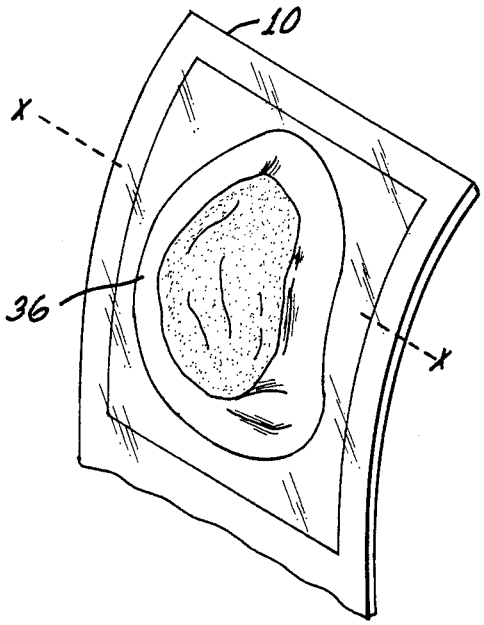
FIG. 8B is a perspective view showing how the product containing pod may be popped up out of the plane of the element simply by bending the latter.

Desirably the pod area 14 includes a molded elliptical pod 18, the cross section of which is best shown in FIG. 2. The pod 18 itself may be formed in a domed configuration with a bottom wall 20 and a side wall 22. The rim 24 of the sidewall 22 desirably lies above the plane 26 of the element 10. As may also be seen from FIGS. 1 and 2, in molding the pod 18 in the plastic element 10, it is desirable also to mold around the pod a further wall 28 which is U-shaped in cross-section to define a cavity 30 which surrounds the pod 18. Desirably the peak 32 of the U-shaped wall 28 extends further from the plane 26 than does the bottom wall 20 of the pod 18. Thereby, a recess 34 is provided to enable the user of the sampler to insert her fingertip in the manner shown in FIG. 8. The wall may be thinner than side wall 22 of the pod 18 and element 10 in order to enable the pod 18 to be popped up out of the plane of the element 10.

A sample quality of the product 36 is deposited in the pod and secured therein by a thin plastic cover sheet 38 which may also cover the remainder of the element 10. Desirably, in filling and assembling the sampler following the molding of the elongated element 10, the latter is turned over so that the product 36 may be deposited and retained in the pod 14 by gravity. The thin plastic sheet 38 is coated on the side which contacts the element 10 with an adhesive (not shown) of type which allows the cover sheet 38 to be peeled off those portions of the element 10 with which the adhesively coated sheet 38 is brought into contact. To facilitate peeling off the sheet 38 in order to secure access to the product 36, a break or bend line 40 may be provided at one end 42 of the element 10.

Figure 9:
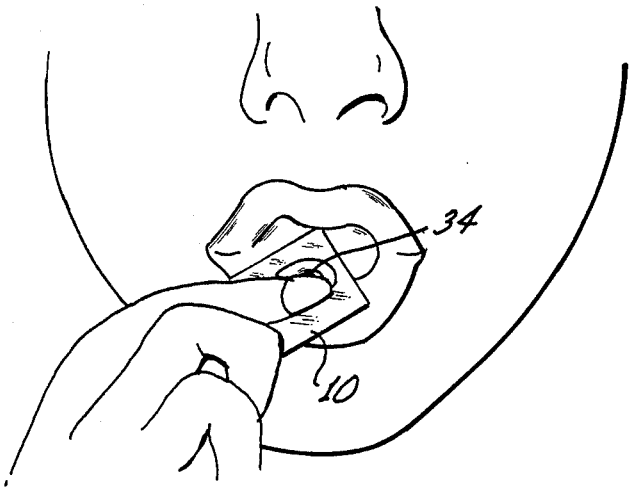
FIG. 9 is a sketch showing the manner in which the dispenser applicator of the present invention may be utilized as a lipstick sampler.

In use, as shown in FIGS. 7, 8A, 8B, and 9, the cover sheet 38 is peeled back to expose the small sample of the product 36, and may be removed altogether from the element 10 and discarded. Then the person proposing to try the sample may insert her finger into the recess 34 behind the pod 18 in the manner shown in FIG. 8A and, by pushing gently, will cause the pod with its product 36 to pop up above the plane of the element 10, so that the product sample 36 may readily be applied to her lips in the manner shown in FIG. 9. Alternatively, the pod 18 may be popped up simply by bending the element 10 about an axis x—x as shown in FIG. 9. After the product sample 36 has thus been applied to the lips, the entire device may be discarded.

Figure 4:
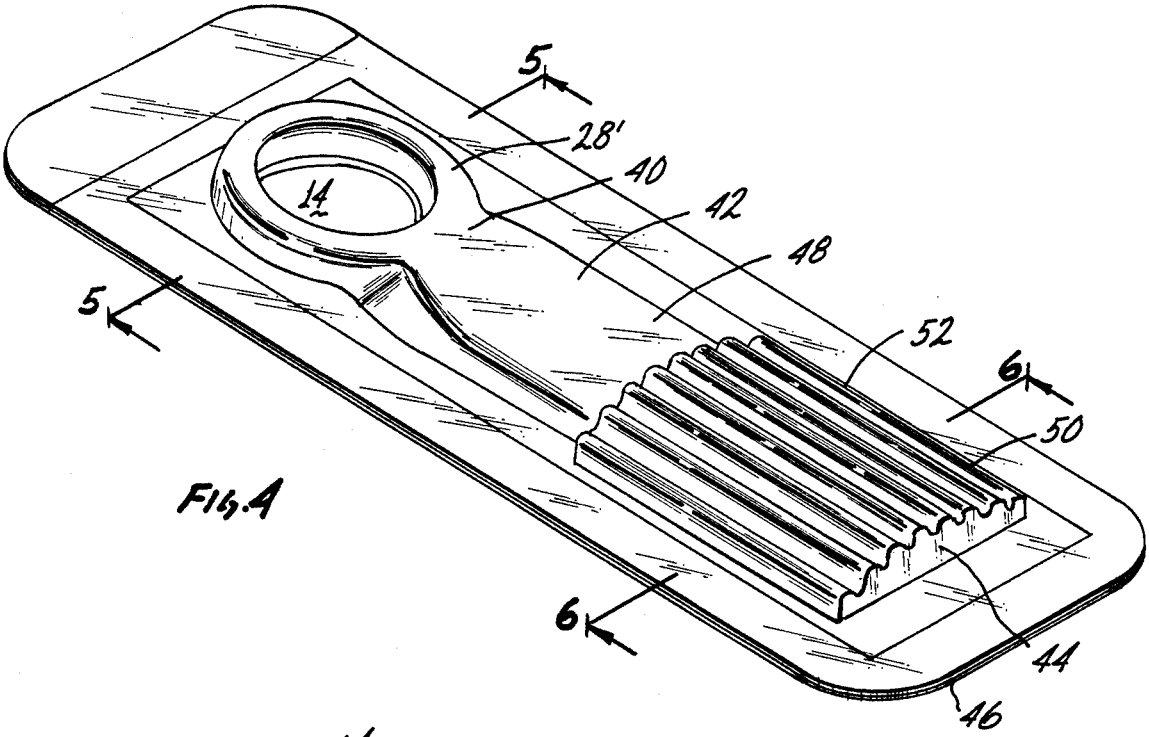
FIG. 4 is a perspective view similiar to that of FIG. 1, of a modified version of the invention.
Figure 5:
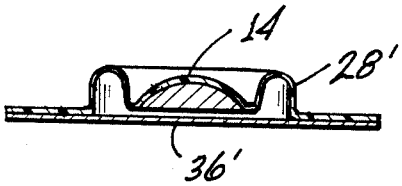
FIG. 5 is a section taken on the line 5—5 of FIG. 4.
Figure 6:
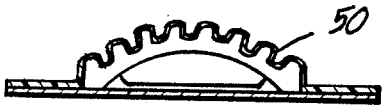
FIG. 6 is a section taken on the line 6—6 of FIG. 4.
Figure 7:
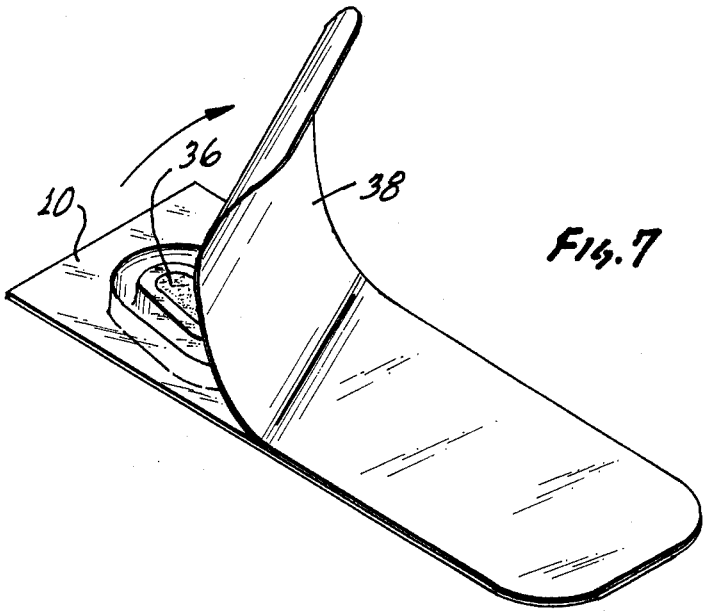
FIG. 7 is a perspective view taken from the upper side of the embodiment of FIG. 1 showing the cover sheet being peeled off.

FIGS. 4, 5, and 6 disclose an alternate, but related, embodiment of the present invention. As best shown in FIG. 4, and viewed in conjunction with FIG. 6, the U-shaped wall 28' does not completely surround pod 14. Instead it opens up at 40 at the end of the pod facing the handle segment 12 to form a hood 42 extending to an end wall 44 adjacent the handle segment end 46. As may be seen from FIGS. 4 and 6 a portion 48 of the hood 42 may be simply rounded and smooth, while a plurality of gripping ridges 50 may be molded into the more remote portion 52 of the hood 42. By providing such a hood 42, the sampler of the present invention may be configured to resemble the lipstick or other item, a sample of which is incorporated as the product 36'. Despite the structural differences illustrated and described with respect to the embodiment of FIGS. 4–6, the product 14 is filled, covered, and utilized in the same manner as the embodiment of FIGS. 1–3 inclusive.

Figure 10:
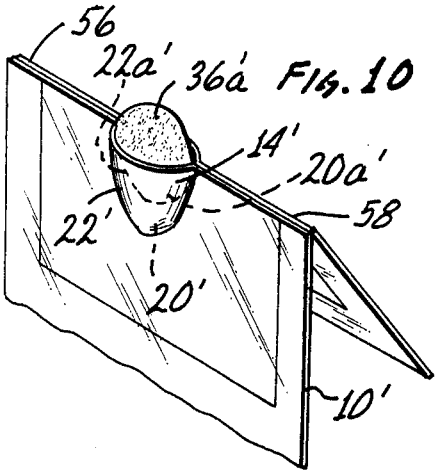
FIG. 10 is a perspective view of another embodiment of the invention showing the planar element bent back to expose the product sample for use.

In the further embodiment of FIG. 10, the pod 14' need not be surrounded by a U-shaped wall, but instead, its bottom and side walls 20', 22' respectively, may be scored at 54 to form a break line in alignment with a scored bend line 56–58 on the element 10' on each side of the pod 14'. As may be seen in FIG. 10, when the upper part 10a' of the element 10' is best back along the line 56–58, the pod 14' ruptures along its score line 54 to enable upper halves 20a', 22a' of its bottom and side walls 20', 22' respectively, also to bend back and pull away from the product sample 36; thereby exposing the upper half 36a' of the product 36' for application to the person's lips.

From the foregoing description and the accompanying illustrations provided in the drawings, it may be readily appreciated that the present invention provides an effective product sampler which may be particularly desirable and effective for lipstick sampling. The basic container dispenser, is easily molded, as by vacuum forming, following which it may be passed to a product filling station where a sample product 36 may be deposited in the pod 18. The entire side of the elongated element 10 having the open pod 18 filled with product 36, may then be effectively covered by the peelable adhesive sheet 38.

The cost of fabricating and filling these samplers in mass production may be in the order as low as a few cents. Thus, the manufacturer of the product may distribute dozens of these product samplers at a total cost which may be less than that of a single one of the lipsticks heretofore made available as "testers". Nor need theft be a concern, since the sales clerk would be the one to hand a single sample to the customer. More importantly, however, is the fact that each sample is intended for only a single use by a prospective customer, so that there is no chance of the customer picking up any virus or bacteria deposited by a prior user, as has been the case with the conventional "tester".

Certain proposed embodiments of the present invention have been made the subject of a Disclosure Document Submission which was transmitted to the U.S. Patent and Trademark Office Feb. 12, 1987, and received a Disclosure Document No. 164,319.

I claim:

1. A sealed sample dispenser-applicator for a liquid, solid, semi-solid, pressed powder, or plastic product presenting a smearable surface, such as a lipstick, said dispenser applicator comprising:

A. An elongated molded thin flexible planar plastic support element, said element having a handle segment extending from one end partially toward the opposite end, and a product retaining pod disposed near said opposite end of said element, said pod extending out of the plane of said element and having a bottom wall, a side wall, and an open top, defined by the rim of said side wall disposed in said plane, B. A predetermined sample quantity of product disposed in said pod, and C. A thin plastic cover sheet laid over the open top of said pod, to cover the product disposed therein, in removable, but sealing engagement with the rim of the pod side wall, said cover sheet being manually removable from said pod to expose the product for application sampling.

2. The dispenser applicator as described in claim 1, wherein at least a portion of the pod is surrounded by a second wall defining a cavity which is U-shaped in cross-section, and of thinner material thanthat of the pod and the remainder of the plastic support element, whereby the pod may be popped up out of the plane of said element by finger pressure or bending of the support element, to enable the product to be applied to a surface, such as a user's lips.

3. The dispenser applicator as described in claim 2 wherein said second wall extends out of said plane by a greater distance than said side wall, thereby to provide, with the bottom wall of the pod, a fihger receiving recess.

4. A dispenser applicator is described in claim 1 wherein a portion of said handle segment of said element is disposed out of said plane in the same direction as the pod in a plurality of elongated ridges to form gripping means for said dispenser applicator.

5. The dispenser applicator as defined in claim 1 wherein the plastic cover sheet is opaque and adapted to receive printing on either side.

6. The sample dispenser as described in claim 4, wherein a portion of the handle segment of the element is disposed out of the plane in the same direction as the pod to extend from at least a portion of the ridges to said second wall, thereby to define a hood extending between the side wall and at least a portion of said ridges.

7. The dispenser applicator as described in claim 1, wherein said element is scored transversely along a line extending through the pod to enable one end of said element to be bent back about said score line, and the bottom and side walls of said pod are also scored along a line coinciding with the element score line, but to such an extent that when one end of the element is so bent back, the bottom and side walls of the pod rupture and are pulled back away from the product sample to expose the same for use.

* * * * *